United States Patent [19]

Wood et al.

[11] 4,330,087

[45] May 18, 1982

[54] IMPULSE SPRINKLER DEFLECTOR SPOON

[75] Inventors: William A. Wood; Frank J. D'Amore, both of Glendora, Calif.

[73] Assignee: Rain Bird Sprinkler Manufacturing Corporation, Glendora, Calif.

[21] Appl. No.: 133,007

[22] Filed: Mar. 24, 1980

[51] Int. Cl.[3] ..... B05B 3/02

[52] U.S. Cl. ..... 239/233

[58] Field of Search ..... 239/230, 231, 232, 233, 239/500, 511

[56] References Cited

U.S. PATENT DOCUMENTS 3,726,479 4/1973 Leissner et al. ..... 239/233

3,930,617 1/1976 Dunmire ..... 239/233 X

*Primary Examiner*—Robert B. Reeves

*Assistant Examiner*—Gene A. Church

[57] ABSTRACT

A deflector spoon for a rotary impulse sprinkler includes upper and lower relatively sharply curved deflector faces separated by an intermediate, relatively gradually ramped deflector face. The three deflector faces are designed to react with a water stream from a sprinkler nozzle with the same driving force regardless of the specific water stream trajectory.

11 Claims, 5 Drawing Figures

IMPULSE SPRINKLER DEFLECTOR SPOON

BACKGROUND OF THE INVENTION

This invention relates generally to rotary impulse sprinklers of the type generally described in U.S. Pat. Nos. 1,997,901 and 2,380,101. More specifically, this invention relates to an improved deflector spoon for use with a rotary impulse sprinkler, and for providing substantially consistent sprinkler operation regardless of the specific sprinkler nozzle geometry.

Rotary impulse sprinklers in general are well known in the art. Such sprinklers typically comprise a journalled sprinkler body with a sprinkler nozzle for directing a collimated water stream upwardly and outwardly. The sprinkler body carries an oscillating lever including a deflector spoon springably biased into engagement with the water stream. The spoon is geometrically configured to be driven by the water stream against the force of the spring to cause a portion of the lever to impact the sprinkler body and thereby rotate the sprinkler body. After impact, the spring once again urges the deflector spoon back into engagement with the water stream, whereby the oscillating lever rotates the sprinkler body in a continuous sequence of small angular steps. The sprinkler body may be designed to rotate through a complete circle, or may include a conventional reversing mechanism for causing the sprinkler body to oscillate repeatedly through a partial circle.

While rotary impulse sprinklers are widely used, th operating characteristics of these sprinklers are susceptible to various parameters such as water pressure,nozzle size and trajectory, and deflector spoon geometry. Of these parameters, nozzle configuration is particularly important since these impulse-type sprinklers are frequently designed for receiving interchangeable nozzles suited for a specific sprinkler operating environment. That is, a given sprinkler body and deflector spoon design may be adapted readily for any of a variety of desired operating characteristics by selection of the specific nozzle design. For example, a nozzle with a raised or lowered trajectory may be provided where the sprinkler is used in windy conditions, or is required to spray over or under shrubs or trees or the like. However, for optimum operation, it is desirable to design the deflector spoon so that it moves into and out of the water stream at substantially a constant rate regardless of the geometry of the water stream emanating from the sprinkler nozzle. Accordingly, it is desirable to provide a deflector spoon geometry which provides substantially similar operating characteristics regardless of the nozzle configuration, and thereby accommodates a variety of nozzles.

In the prior art, various deflector spoon geometries have been proposed in an attempt to provide relatively consistent deflector spoon operation with a variety of nozzle geometries. However, these proposed spoon designs have relied upon a minimization of spoon surface for reacting with the water stream by providing a deflector spoon geometry with one or more cutout portions. See, for example, U.S. Pat. No. 3,726,479 wherein upper and lower portions of the deflector spoon are omitted, and U.S. Pat. No. 3,930,617 wherein the central portion of the deflector spoon is omitted. However, these deflector spoon geometries are unsatisfactory for use with nozzle geometries of varying trajectory, since the water stream from some nozzles will fail to react with the deflector spoon sufficiently for proper operation.

The present invention overcomes the problems and disadvantages of the prior art by providing a specifically configured deflector spoon geometry for an impulse sprinkler, wherein the deflector spoon is designed for substantially similar operating characteristics regardless of the sprinkler nozzle trajectory.

SUMMARY OF THE INVENTION

In accordance with the invention, a deflector spoon for a rotary impulse sprinkler comprises a deflector web having a generally vertically extending, angularly disposed wall for engagement with a water stream emanating from a sprinkler nozzle. The web is designed for reaction with the water stream for pulling the deflector spoon into the water stream. The water stream then passes behind the deflector web into a dish-shaped deflector portion comprising a generally vertical side wall extending radially with the flow direction of the water stream, and terminating in a front wall curved laterally in front of the water stream for interaction therewith. The water stream drives the deflector portion against the force of a biasing spring away from the water stream for impact with a portion of the sprinkler to partially rotate the sprinkler, whereupon the spring urges the deflector spoon back into engagement with the water stream for subsequent and successive reaction therewith.

The side and front walls of the spoon deflector portion are configured to form a relatively sharply curved, or deep-dished, upper deflector face extending over approximately the upper third of the deflector portion, and a correspondingly relatively sharply curved or deep-dished lower deflector face extending over approximately the lower third of the deflector portion. These upper and lower deflector faces are separated by an intermediate, relatively gradually ramped deflector face. These three deflector faces combine together to react with the water stream to provide substantially the same driving force upon the deflector spoon regardless of the specific sprinkler nozzle trajectory configuration. More specifically, a water steam having its centerline trajectoried in alignment with the ramped deflector face imparts a given driving force to the deflector spoon. Other water streams having their centerlines raised or lowered in alignment substantially with the upper deflector face, or with the lower deflector face also impart a driving force to the deflector spoon. However, these latter streams are known to possess relatively lesser energy for driving the deflector spoon. In this regard, the deep-dished upper and lower deflector faces are configured to extract more driving energy from the water stream than the ramped face, whereby substantially the same driving energy is imparted to the deflector spoon regardless of the trajectory of the water stream emanating from the nozzle.

BRIEF DESCRIPTION OF THE DRAWINGS

The accompanying drawings illustrate the invention. In such drawings.

DETAILED DESCRIPTION OF THE PREFERRED EMBODIMENT

Figure 1:
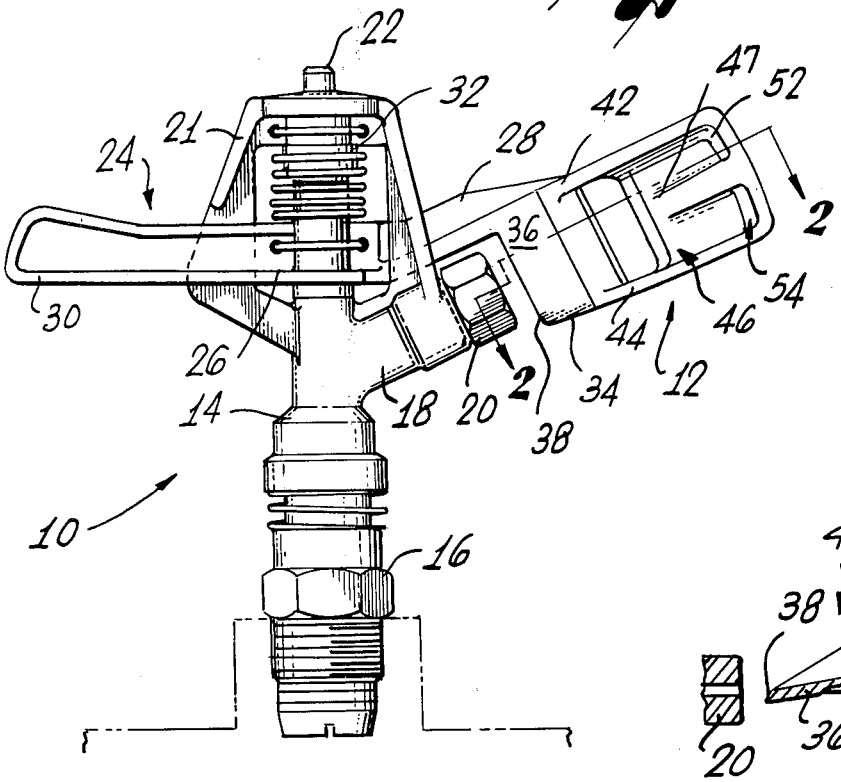
FIG. 1 is a side view of an impulse sprinkler incorporating the deflector spoon of this invention.

A rotary impulse sprinkler 10 including a deflector spoon 12 of this invention is shown in FIG. 1, and generally comprises a sprinkler body 14 mounted for rotation within a journal assembly 16 which in turn is secured to a water supply riser (not shown), all in a well-known manner. The sprinkler body 14 includes an upwardly and laterally directed nozzle arm 18 which is internally threaded at its outer end for threadably and removably receiving a sprinkler nozzle 20 having a specific geometry chosen according to the desired sprinkler application.

A journal pin 22 extends upwardly from the sprinkler body 14 within a frame 21 formed integrally with the sprinkler body. The journal pin 22 receives an oscillating lever 24 having a central bearing portion 26, rotatably received over the journal pin. From the bearing portion 26, a reactant arm 28 extends on one side of the frame 21, and a generally diametrically opposed counterbalancing arm 30 extends on the other side of the frame 21. A coil spring 32 has its opposite ends connected to the frame 21 and to the lever 24 so as to urge the reactant arm 28 toward a position for interaction with a water stream enamating from the nozzle 20.

Figure 2:
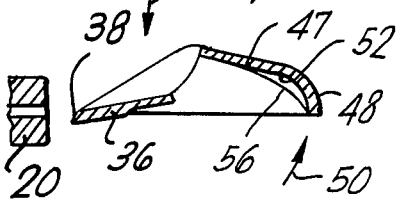
FIG. 2 is an enlarged fragmented section taken on the line 2—2 of FIG. 1.

As shown in detail in FIGS. 1 and 2, the reactant arm 28 includes the deflector spoon 12 of this invention for interacting with the water stream. This deflector spoon 12 comprises a bracket portion 34 extending downwardly in front of the nozzle 20. This bracket portion 34 defines a deflector web 36 in the form of a vertically upstanding wall disposed immediately in front of the nozzle 20. This web 36 extends substantially radially away from the nozzle 20 generally in alignment with the water stream, and includes a rear face 38 of relatively small width angularly configured to draw the web into and past the water stream in the direction of arrow 40 in FIG. 2.

Upper and lower struts 42 and 44 extend forwardly from the upper and lower ends of the deflector web 36 generally in parallel with the sprinkler body nozzle arm 18. These struts 42 and 44 merge at their forward ends to form a dished spoon or deflector portion 46. This deflector portion 46 comprises a vertically extending side wall 47 which is angularly offset with respect to the deflector web 36 and the water stream for receiving the water stream as it passes behind the deflector web 36 as shown in FIG. 2. Importantly, this side wall 47 terminates at its forward end in a front wall 48 curved or dished laterally in front of the received water stream for reaction with the water stream. That is, the water stream impacts the side and front walls 47 and 48 to impart a lateral driving energy to the deflector portion 46 which drives the deflector portion 46 in the direction of arrow 50 in FIG. 2 away from the water stream. This causes the reactant arm 28 to swing away from the water stream against the force of the spring 32, with the spring eventually overcoming the water stream driving force to urge the deflector spoon 12 back toward engagement with the water stream for the next successive cycle. As this happens, the counterbalancing arm 30 repeatedly impacts the sprinkler body 14 or frame 21 to partially rotate the sprinkler body about its own axis all in a well-known manner. Conveniently, as shown, the struts 42 and 44 merge with the side wall 47 and the front wall 48 to close partially the top and bottom of the deflector portion 46.

The deflector spoon 12 includes a specifically configured deflector portion 46 designed to allow the deflector spoon to exhibit substantially constant operating characteristics regardless of the trajectory of the water stream from the nozzle 20. That is, as shown in the drawings, the side wall 47 and the front wall 48 of deflector portion 46 define an upper relatively sharply curved deflector face 52 and a complementary, lower relatively sharply curved deflector face 54. These upper and lower deflector faces 52 and 54, respectively, occupy approximately one-third each of the vertical dimension of the deflector portion 46, and function to impact with the water stream to extract a relatively large magnitude of driving energy from the water stream by virtue of the relatively sharp change in stream direction. This results in a substantially dynamic driving force for driving the deflector spoon 12 against the bias of the spring 12 out of contact with the water stream.

An intermediate, relatively gradually curved or ramped deflector face 56 separates the sharply curved upper and lower deflector faces 52 and 54. This ramped face 56 occupies at the center of the deflector portion 46 approximately one-third of the vertical dimension of said deflector portion, and defines a relatively low-angle ramp extending from the side wall 47 and terminating at the forward lateral margin of the front wall 48. This ramped face is designed to extract from the water stream relatively lesser driving energy as compared with the upper and lower deflector faces 52 and 54 by virtue of the significantly lesser change in water stream direction.

Figure 3:
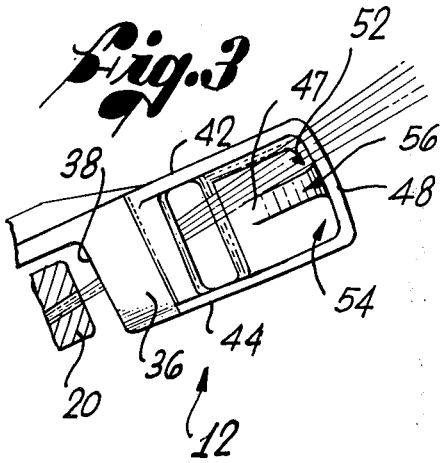
FIG. 3 is an enlarged fragmented side view illustrating interaction of the deflector spoon with a water stream from a first nozzle geometry.
Figure 4:
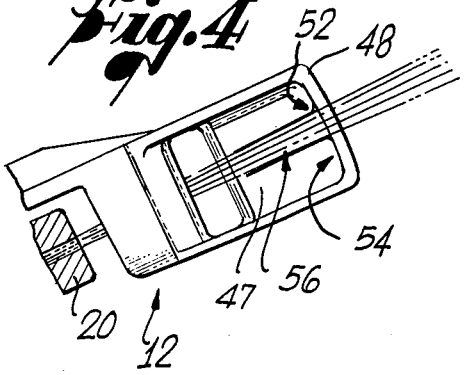
FIG. 4 is an enlarged fragmented side view illustrating interaction between the deflector spoon and a water stream from a second nozzle geometry.
Figure 5:
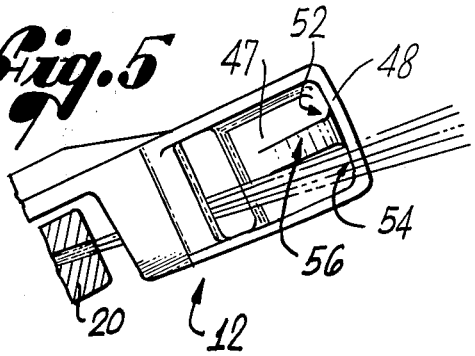
FIG. 5 is an enlarged fragmented side view illustrating interaction between the deflector spoon and a water stream from a third nozzle geometry.

Operation of the deflector spoon of this invention is illustrated in FIGS. 3–5. As shown in FIG. 3, some nozzles 20 are configured to provide a water stream with a stream centerline trajectoried substantially in alignment with the upper deflector face 52 of the deflector spoon 12. Other nozzles, as shown in FIG. 5 are configured to provide a water stream with a stream centerline trajectoried substantially in alignment with the lower deflector face 54. In both instances, the deflector faces 52 and 54 present the same deflector geometry for impaction with the water stream whereby the deflector spoon is driven with substantially identical operating characteristics. In both cases, the change in water stream direction is relatively severe so that substanial driving energy is extracted from the water stream. However, with raised or lowered water stream trajectories shown in FIGS. 3 and 5, the available energy in the water stream for driving the deflector spoon 12 is somewhat less than the available driving energy of a water stream having its centerline aligned with the vertical centerline of the deflector portion 46 of the spoon 12, as shown in FIG. 4.

A nozzle 20 is shown in FIG. 4 emitting a water stream with its centerline in parallel alignment with the centerline of the deflector portion 46. This water stream is also in alignment with the ramped face 56, and thus imparts the majority of its driving force to the deflector portion 46 via the ramped face 56. However, the ramped face provides a lesser and more gradual change of stream direction as compared with the upper and lower deflector faces 52 and 54, and thereby extracts a lesser amount of stream energy for driving the deflector spoon 12. The result is that the ramped face 56 yields a driving force to the deflector spoon 12 substantially the same as that provided by the upper or lower deflector faces 52 or 54 such that the deflector spoon 12 operates at substantially the same rate regardless of water stream trajectory.

While three specific nozzle trajectory configurations are described herein, it should be understood that a variety of other nozzle trajectories are possible. For example, a nozzle trajectory may be chosen intermediate of those shown in FIGS. 3 and 4, or intermediate of those shown in FIGS. 4 and 5. However, as the stream trajectory departs in either direction from the centerline of the ramped face 56, the available energy in the stream for driving the deflector spoon 12 decreases. When this happens, the portion of the stream impacting either the upper or lower deflector face 52 or 54 increases to increase correspondingly the capability of the deflector portion 46 to extract driving energy from the water stream. The end result is that the streams at a given water pressure and velocity operates the deflector spoon 12 at substantially the same rate regardless of water stream trajectory.

Various modifications and improvements of the improved deflector spoon described in the foregoing specification are believed to be possible to one skilled in the art without varying from the scope of the invention. Accordingly, no limitation of the invention is intended except by way of the appended claims.

We claim:

1. A deflector spoon for an impulse sprinkler including a nozzle arm for receiving any one of a plurality of nozzles, and means for urging said deflector spoon into engagement with a water stream from the nozzle, said deflector spoon comprising:

a deflector web including an upstanding wall extending generally radially away from the nozzle and having an angularly disposed rear face for engagement with the water stream and for thereupon drawing said web into and past the water stream;

at least one strut extending forwardly from said deflector web away from the nozzle; and a deflector portion carried by said strut and spaced from said web, said deflector portion including an upstanding side wall angularly offset with respect to said deflector web for receiving the water stream when said web has moved past the water stream, a front wall at the forward end of said side wall extending laterally in front of the received water stream for reaction therewith, and a relatively gradually sloped ramp extending centrally from said side wall to the forward and lateral central margin of said front wall;

said side wall, front wall, and ramp together defining an upper relatively sharply curved deflector face and a lower relatively sharply curved deflector face separated by said gradually sloped ramp.

2. A deflector spoon as set forth in claim 1 wherein said upper and lower deflector faces extend respectively each over approximately one-third of the vertical dimension of said deflector portion, and said ramp extends over approximately one-third of the vertical dimension of said deflector portion.

3. A deflector spoon as set forth in claim 1 including an upper strut and a lower strut respectively extending forwardly from said deflector web, said deflector portion being carried by said upper and lower struts, said struts merging with said side wall and said front wall to close partially the upper and lower ends of said deflector portion.

4. A deflector spoon as set forth in claim 1 wherein the nozzle is selected to provide a water stream having a trajectory within a predetermined range of trajectories, said upper and lower deflector faces and said ramp combining to react with the water stream to move the deflector spoon into and out of the water stream at substantially the same rate regardless of the specific trajectory of the water stream.

5. A deflector spoon for an impulse sprinkler including support means for urging said deflector spoon into engagement with a water stream from a nozzle on the sprinkler, said deflector spoon comprising:

a deflector portion carried by the support means, said deflector portion including an upstanding side wall extending generally radially away from the nozzle and angularly with respect to the water stream for receiving the water stream, a front wall at the forward end of said side wall extending generally laterally in front of the water stream for reaction therewith, and a generally gradually sloping ramp extending centrally from said side wall to the forward and lateral central margin of said front wall;

said side wall, front wall, and ramp together defining an upper relatively sharply curved deflector face and a lower relatively sharply curved deflector face separated by said gradually sloping ramp, said upper and lower deflector faces and said ramp combining to react with the water stream by changing the direction thereof to extract from the water stream substantially the same force for driving said deflector portion out of the water stream regardless of the specific water stream trajectory.

6. A deflector spoon as set forth in claim 5 wherein said upper and lower deflector faces extend respectively each over approximately one-third of the vertical dimension of said deflector portion, and said ramp extends over approximately one-third of the vertical dimension of said deflector portion.

7. A deflector spoon as set forth in claim 5 including means at the upper and lower ends of said deflector portion for closing partially said upper and lower ends.

8. In an impulse sprinkler having a sprinkler body, and a nozzle arm for receiving any one of a plurality of nozzles selected to provide a water stream having a trajectory within a predetermined range of trajectories, a deflector spoon;

means carrying said deflector spoon for oscillation with respect to said sprinkler body to move said deflector spoon into and out of engagement with the water stream; and spring means for urging said deflector spoon into engagement with the water stream;

said deflector spoon including a deflector web with an upstanding wall extending generally radially away from the nozzle and having an angularly disposed rear face for engagement with the water stream and for thereupon drawing said web into and past the water stream, at least one strut extending forwardly from said deflector web generally away from the nozzle, a deflector portion carried by said strut and spaced from said web, said deflector portion including an upstanding side wall extending generally radially away from the nozzle and angularly offset with respect to said web for receiving the water stream when said web has moved past the water stream, a front wall at the forward end of said side wall extending laterally in front of the received water stream for reaction therewith, and a relatively gradually sloping ramp extending centrally from said side wall to the forward and lateral central margin of said front wall; said side wall, front wall, and ramp together defining an upper relatively sharply curved deflector face and a lower relatively sharply curved deflector face separated by said gradually sloping ramp, said upper and lower deflector faces and said ramp combining to react with the water stream by changing the direction thereof to extract from the water stream substantially the same force for driving said deflector portion out of the water stream regardless of the specific water stream trajectory.

9. A deflector spoon as set forth in claim 8 including means at the upper and lower ends of said deflector portion for closing partially said upper and lower ends.

10. A deflector spoon as set forth in claim 8 wherein said upper and lower deflector faces extend respectively each over approximately one-third of the vertical dimension of said deflector portion, and said ramp extends over approximately one-third of the vertical dimension of said deflector portion.

11. A deflector spoon as set forth in claim 8 including an upper strut and a lower strut respectively extending forwardly from said deflector web, said deflector portion being carried by said upper and lower struts, said struts merging with said side wall and said front wall to close partially the upper and lower ends of said deflector portion.

* * * * *